US007938713B2

(12) United States Patent
Trieb et al.

(10) Patent No.: US 7,938,713 B2
(45) Date of Patent: May 10, 2011

(54) DEVICE FOR WATER-JET CUTTING OR ABRASIVE WATER-JET CUTTING UNITS

(75) Inventors: Franz Trieb, Kapfenberg (AT); Alwin Timmermann, Cologne (DE)

(73) Assignee: BHDT GmbH, Kapfenburg (AT)

( * ) Notice: Subject to any disclaimer, the term of this patent is extended or adjusted under 35 U.S.C. 154(b) by 1112 days.

(21) Appl. No.: 11/677,368

(22) Filed: Feb. 21, 2007

(65) Prior Publication Data

US 2007/0207702 A1 Sep. 6, 2007

(30) Foreign Application Priority Data

Feb. 22, 2006 (AT) ..... GM129/2006

(51) Int. Cl.
*B24C 3/00* (2006.01)
*B24B 49/00* (2006.01)

(52) U.S. Cl. ..... 451/2; 451/8; 451/38; 451/75; 451/91; 83/22; 83/53; 83/63; 83/177; 239/101; 239/569; 239/543; 239/DIG. 8

(58) Field of Classification Search ..... 451/2, 8, 451/38, 75, 91; 83/13, 22, 53, 78, 98, 177, 83/63; 251/14, 60, 63; 239/543, 569, 101, 239/417, 419, DIG. 8
See application file for complete search history.

(56) References Cited

U.S. PATENT DOCUMENTS

| | | | | |
|---|---|---|---|---|
| 5,283,991 | A | 2/1994 | Keizers | |
| 5,755,424 | A * | 5/1998 | Ryd | 251/63 |
| 6,220,529 | B1 * | 4/2001 | Xu | 239/569 |
| 7,559,489 | B2 * | 7/2009 | Noestheden | 239/101 |
| 2004/0132389 | A1 | 7/2004 | Miller | |
| 2007/0013922 | A1 * | 1/2007 | Scott et al. | 356/626 |

FOREIGN PATENT DOCUMENTS

| | | |
|---|---|---|
| JP | 03-003799 | 1/1991 |
| JP | 06-143146 | 5/1994 |
| WO | 95/29792 | 11/1995 |
| WO | 02/087827 | 11/2002 |

* cited by examiner

*Primary Examiner* — Eileen P. Morgan
(74) *Attorney, Agent, or Firm* — Greenblum & Bernstein, P.L.C.

(57) ABSTRACT

Control device and method for controlling the impingement of the workpiece by a water jet or an abrasive water jet in a cutting unit. Control device includes a feeder composed of at least two flow-through areas positionable between a high-pressure water supply and a jet nozzle of the cutting unit. At least one of the flow-through areas includes a high pressure area, and at least one of the flow-through areas includes a pressure-reducing area. At least one switchable valve is arranged in the high-pressure area, a pressure-reducing mechanism is arranged in the pressure reducing area, and an impingement line is coupled to the at least two flow-through areas and coupleable to the jet nozzle.

21 Claims, 1 Drawing Sheet

DEVICE FOR WATER-JET CUTTING OR ABRASIVE WATER-JET CUTTING UNITS

CROSS-REFERENCE TO RELATED APPLICATIONS

The present application claims priority under 35 U.S.C. §119 of Austrian Patent Application No. GM 129/2006, filed Feb. 22, 2006, the disclosure of which is expressly incorporated by reference herein in its entirety.

BACKGROUND OF THE INVENTION

1. Field of the Invention

The invention relates generally to a method and device for controlling the impingement of the workpiece by a water jet or an abrasive water jet in a cutting unit.

2. Background and Related Information

Units in which a thin water jet strikes a workpiece at high speed and with high energy so as to cut and/or sever the workpiece with a relative motion, so as to cut the workpiece, are generally known in the field. In addition, water alone, or water and particles that have an abrasive effect and are carried along therein, can also be used to cut and/or sever workpieces.

Water jet or abrasive water jet devices are essentially used to cut out desired shapes from optionally hard and/or brittle flat workpieces. Precise contours are advantageously produced from glass areas, e.g., panes, e.g., by way of abrasive water cutting units.

In some water jet cutters, if a cut is created in cutting units through relative guidance of the cutting jet from outside into a flat workpiece, this jet can be embodied with a high pressure and high speed or energy necessary for a high cutting power.

In many cases, workpieces of a flat raw material of oversized production can also be cut out by way of a water jet or abrasive water jet method, whereby either a cut can be created starting from the edge, or a through hole is first made in the material surface or material wall, starting from which hole the penetrating jet is effective in producing a cut with relative motion.

With brittle materials, such as, for example, glass or the like, creating a hole through the raw material wall is often difficult because the abrasive water jet has a high impact pressure that can lead to the destruction or fracture of the raw material.

In order to minimize this danger when placing a through hole, also referred to as "piercing," the cutting jet directed at the surface until penetration through the material wall is usually embodied with reduced energy or reduced pressure, after which a substantial increase in pressure occurs to actually create a cut.

Typical formation of a through hole is made in a raw material wall with reduced pressure application, after which an increase in pressure of the jet medium occurs and a cut is produced through targeted relative motion between raw material and jet nozzle, and further includes a switch-over action of the nozzle impingement. However, the conventional methods and devices which include a switch-on and switch-over action of this type with pressures in the medium of up to 450 MPa can be time-consuming and/or subject the unit parts to considerable wear.

SUMMARY OF THE INVENTION

The method and device for controlling the impingement of the workpiece by a water jet or an abrasive water jet in a cutting unit described herein addresses the needs explained above by providing an efficient shift or switch-over of a cutting unit from piercing pressure to operating pressure of a water jet or of an abrasive water jet. Thus, the present invention provides a method and device which is economically advantageous, as well advantageous in systems engineering terms by providing longer life to the components in the cutting unit.

The present invention provides a device that has much lower maintenance or repair requirements. Further, the water producing impingement can be switched to a high pressure, namely the cutting pressure, immediately after creation of a through hole in a flat raw material, if possible, without any loss of time.

The present invention provides a control device which can be positioned between a high-pressure water supply, e.g., a high-pressure pump, and a jet nozzle of the unit. The control device can further include a feeder and at least two flow-through areas guided parallel in at least one location. These areas can be ultimately merged again in an impingement line of the nozzle. At least one of the flow-through areas is embodied or formed as a high-pressure area with at least one switchable valve and at least one further pressure-reducing area can have its pressure reduced.

One advantage of the present invention is that, during feeding of the high-pressure water into the control device, the high-pressure area is impinged up to the switchable valve and the pressure-reducing area is impinged up to the pressure-reducing mechanism. The pressure-reducing mechanism can then be loaded in the direction of the impingement line to the nozzle with the pressure difference, namely high pressure or cutting pressure minus the piercing pressure reduced by the flow in the pressure-reducing mechanism. Thus, if a breakthrough is produced through the workpiece or raw material wall, the valve in the high-pressure area the flow can be released therein, whereby the impingement of the nozzle thus occurs with high pressure. At the same time, the cutting pressure can act back on the pressure-reducing mechanism, which is thus unloaded. This varying load acting only in one direction on the pressure-reducing mechanism can provide better service life and/or durability in intermittent operation.

According to one embodiment of the invention, a switchable valve can be arranged in the pressure-reducing area of the device, which valve is operatively engaged in terms of control engineering with a switchable valve in the high-pressure area.

According to one embodiment of the invention, upon a piercing of a raw material body, the valve in the pressure-reducing area can be opened and a jet impinging the raw material body with reduced energy is thus formed. After the jet breaks through the raw material body, an open setting of the valve in the high-pressure area occurs, whereby a high-energy cutting jet is formed. In on embodiment, the control between the switchable valves is such that the valve in the pressure-reducing area can be switched after the valve in the high-pressure area.

In some embodiments, it has been shown to be advantageous if the pressure-reducing mechanism is arranged in front of the switchable valve in the flow direction of the pressurized water in the pressure-reducing area. In this manner a particularly favorable loading or long service life of the pressure-reducing mechanism can be achieved.

According to another embodiment of the present invention, the pressure-reducing mechanism can be a throttle. In this manner, a baffle can be embodied in the throttle in a particularly stable manner and anchored in the part.

In some embodiments, it has shown to be economically advantageous if at least the switchable valve in the high-pressure area can be controlled by at least one sensor.

For example, immediately after the piercing, i.e., when the jet has produced the breakthrough through the workpiece wall with reduced energy, controlled by the sensor, the high-pressure valve can be opened with only minimal delay and the cutting operation can begin. This does not only represent a time savings, it is also an important step towards the automation of the cutting unit. Sound sensors, optical sensors or the like can be used as sensors to detect the breakthrough of the jet through the workpiece wall.

The present invention provides a control device for controlling the impingement of a workpiece by a water jet or an abrasive water jet in a cutting unit, where the control device includes a feeder composed of at least two flow-through areas positionable between a high-pressure water supply and a jet nozzle of the cutting unit, wherein at least one of the flow-through areas includes a high pressure area, and at least one of the flow-through areas includes a pressure-reducing area; at least one switchable valve arranged in the high-pressure area; a pressure-reducing mechanism arranged in the pressure reducing area; and an impingement line coupled to the at least two flow-through areas and coupleable to the jet nozzle.

In some embodiments, the at least two flow-through areas are structured to be parallel to each other in at least one location In some embodiments, the flow-through areas are ultimately merged to form an impingement line of the jet nozzle, In some embodiments, the control device includes a switchable valve arranged in the pressure-reducing area, where the switchable valve is structured to control a separate switchable valve in the high-pressure area.

In some embodiments, the pressure-reducing mechanism is arranged downstream from the switchable valve in the flow direction in the pressure-reducing area.

In some embodiments, the pressure-reducing mechanism is arranged upstream from the switchable valve in the flow direction in the pressure-reducing area.

In some embodiments, the pressure-reducing mechanism is a throttle.

In some embodiments, at least the switchable valve in the high-pressure area is controlled by at least one hole breakthrough sensor.

In some embodiments, the high-pressure water supply comprises a high-pressure pump.

The present invention further provides a method of controlling the impingement of water on a workpiece by a water jet or an abrasive water jet in a cutting unit, by supplying high-pressure water to a control device having a first and second flow-through area; controlling flow of a portion of the high-pressure water through the first flow-through area; controlling flow of a portion of the high-pressure water through the second flow-through area; piercing a portion of a workpiece with the portion of the water through the second flow-through area; and switching to the portion of water through the first flow-through area to cut the workpiece.

In some embodiments, the first and second flow-through areas merge into an impingement line coupleable to a nozzle.

In some embodiments, a switchable valve is arranged in the pressure-reducing area, and the switchable valve can control a separate switchable valve in the high-pressure area.

In some embodiments, the pressure-reducing mechanism is arranged downstream from the switchable valve in the flow direction in the pressure-reducing area.

In some embodiments, the pressure-reducing mechanism is arranged upstream from the switchable valve in the flow direction in the pressure-reducing area.

In some embodiments, at least the switchable valve in the high-pressure area is controlled by at least one hole breakthrough sensor.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
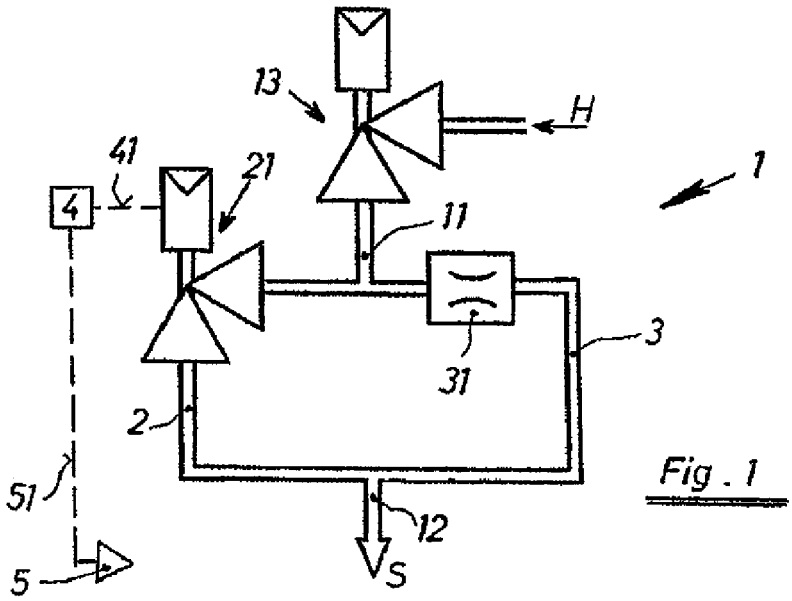
FIG. 1 represents a control device with a switchable valve in the high-pressure area.

FIG. 1 shows diagrammatically a control device 1 to which high-pressure water H can be fed from a water supply, e.g., at a pressure of approximately 420 MPa. Although, it should be noted that the present invention contemplates that the high-pressure water can be fed at any pressure. A switchable valve 13 is located in a feed line 11, such that the device 1 supplies in a controlled manner. A feed line 11 guided further is divided into at least two parallel flow-through areas that are ultimately merged again and form an impingement line 12 for a nozzle (not shown).

With an open setting of a valve 13 in the feed line 11, pressurized water flows into the parallel flow-through areas 2, 3; on the one hand into a high-pressure area 2 up to a closed valve 21, on the other hand into a pressure-reducing area 3 through a pressure-reducing mechanism 31 into an impingement line 12 for a nozzle to form a jet for a piercing of flat material at a reduced pressure of, for example, from approximately 40 to approximately 150 MPa. If a breakthrough of the piercing jet through the material wall occurs, and the jet passes through the formed hole, switchable valve 21 can be opened, whereby high-pressure water is guided through high-pressure area 2 at a pressure of, for example, approximately 420 MPa in the impingement line 12 to the nozzle via a targeted displacement of the flat material relative to the high-pressure cutting jet, this jet acts to produce a cut in the workpiece. Through the high pressure in the impingement line 12, an increase in pressure typically occurs in the pressure-reducing area 3 and a decrease of a flow therein tends to zero.

In an exemplary embodiment, valve 21 can be controlled according to the method by way of the controller 4 and via connecting lines 41 and 51, whereby the control device can be connected to a hole breakthrough sensor 5.

Figure 2:
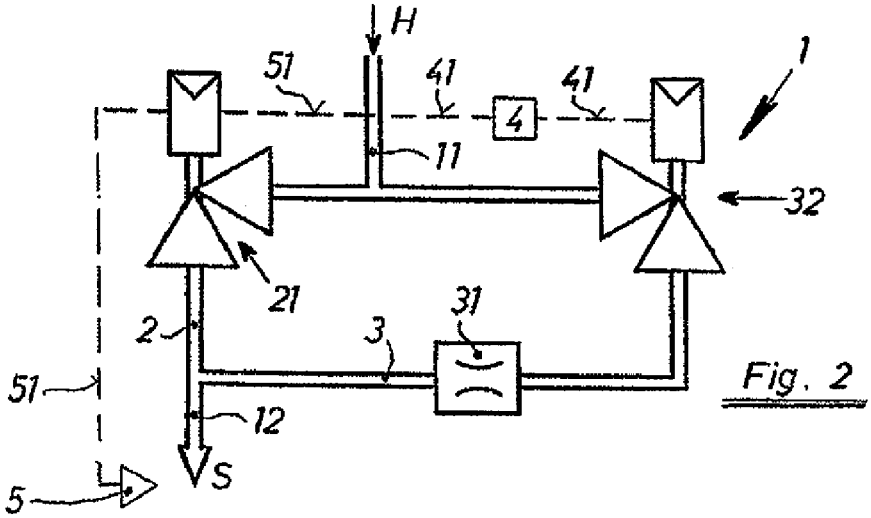
FIG. 2 represents a control device with a switchable valve connected upstream of a pressure-reducing mechanism.

FIG. 2 shows another embodiment of the present invention, including a high-pressure area 2, a controller 4, a pressure-reducing area 3 with a controllable valve 32, and a pressure-reducing mechanism 31 connected downstream in the flow direction.

In another embodiment, the valves 21 and 32 can be controlled according to the method by way of the control device 4 and via connecting lines 41 and 51, whereby controller 4 can be connected to a hole breakthrough sensor 5.

Figure 3:
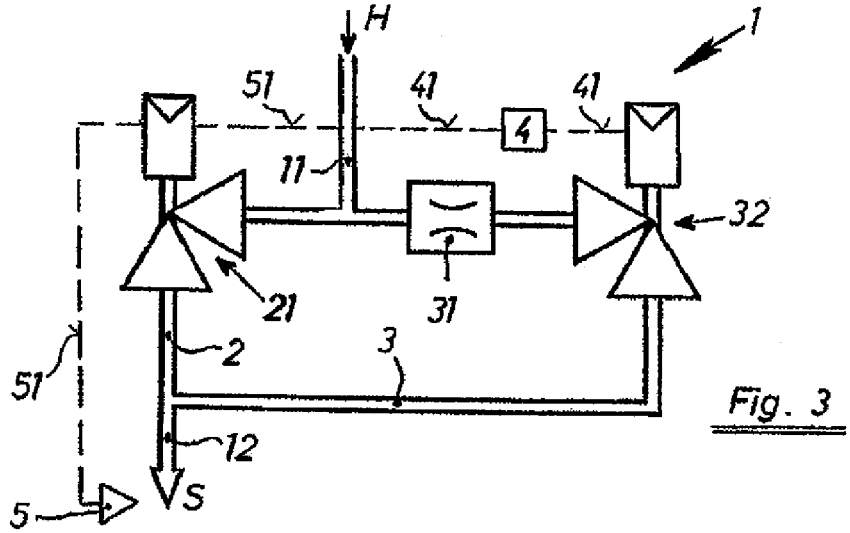
FIG. 3 represents a control device with a switchable valve connected downstream of a pressure-reducing mechanism.

FIG. 3 shows a control device 1 according to another embodiment of the present invention. A pressure-reducing mechanism 31 is connected upstream of a controllable valve 32 in the flow direction in the pressure-reducing area 3.

In this embodiment, the valves 21 and 32 can be controlled according to the method by way of the control device 4 and via connecting lines 41 and 51, whereby the control device can be connected to a hole breakthrough sensor 5.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

What is claimed:

1. A control device for controlling the impingement of a workpiece by a water jet or an abrasive water jet in a cutting unit, the control device comprising:

a feeder composed of at least two flow-through areas positionable between a high-pressure water supply and a jet nozzle of the cutting unit, wherein at least one of the flow-through areas includes a high pressure area, and at least one of the flow-through areas includes a pressure-reducing area;

at least one switchable valve arranged in the high-pressure area;

a pressure-reducing mechanism arranged in the pressure reducing area; and an impingement line coupled to the at least two flow-through areas and coupleable to the jet nozzle; and further comprising:

the at least one switchable valve being arranged in parallel to the pressure reducing area; and at least one hole breakthrough sensor adapted to control the control device.

2. The control device according to claim 1, wherein the at least two flow-through areas are structured to be parallel to each other in at least one location.

3. The control device according to claim 1, wherein the at least two flow-through areas are ultimately merged to form an impingement line of the jet nozzle.

4. The control device according to claim 1, further comprising another switchable valve arranged upstream of the at least one switchable valve in the high-pressure area.

5. The control device according to claim 4, wherein the pressure-reducing mechanism is arranged downstream from the other switchable valve in the flow direction in the pressure-reducing area.

6. The control device according to claim 1, wherein the pressure-reducing mechanism is arranged upstream from another switchable valve arranged in the pressure-reducing area and in the flow direction in the pressure-reducing area.

7. The control device according to claim 1, wherein the pressure-reducing mechanism is a throttle.

8. The control device according to claim 4, wherein the pressure-reducing mechanism is a throttle.

9. The control device according to claim 5, wherein the pressure-reducing mechanism is a throttle.

10. The control device according to claim 1, wherein at least the switchable valve in the high-pressure area is controlled by the at least one hole breakthrough sensor.

11. The control device according to claim 5, wherein at least the switchable valve in the high-pressure area is controlled by the at least one hole breakthrough sensor.

12. The control device according to claim 6, wherein at least the switchable valve in the high-pressure area is controlled by the at least one hole breakthrough sensor.

13. The control device according to claim 1, wherein the high-pressure water supply comprises a high-pressure pump.

14. A control device for controlling the impingement of a workpiece by a water jet or an abrasive water jet in a cutting unit, the control device comprising:

a feeder composed of at least two flow-through areas positionable between a high-pressure water supply and a jet nozzle of the cutting unit, wherein at least one of the flow-through areas includes a high pressure area, and at least one of the flow-through areas includes a pressure-reducing area;

a first switchable valve arranged in the high-pressure area;

a second switchable valve arranged upstream of the first switchable valve;

a pressure-reducing mechanism arranged in the pressure reducing area; and an impingement line coupled to the at least two flow-through areas and coupleable to the jet nozzle, wherein at least the first switchable valve in the high-pressure area is controlled by at least one hole breakthrough sensor.

15. A method of controlling the impingement of water on a workpiece by a water jet or an abrasive water jet in a cutting unit, comprising:

supplying high-pressure water to a control device having a first flow-through area and a second flow-through area;

controlling flow of a portion of the high-pressure water through the first flow-through area using a switchable valve;

controlling flow of a portion of the high-pressure water through the second flow-through area;

piercing a portion of a workpiece with the portion of the water through the second flow-through area; and switching to the portion of water through the first flow-through area to cut the workpiece, wherein:

the switchable valve is arranged in parallel to the second flow-through area; and at least one hole breakthrough sensor is structured and arranged to control the switchable valve.

16. The method according to claim 15, wherein the first and second flow-through areas merge into an impingement line coupleable to a nozzle.

17. The method according to claim 15, wherein the cutting unit further comprises another switchable valve, wherein the other switchable valve is arranged in the second flow-through area, and wherein the other switchable valve controls the switchable valve in the first flow-through area.

18. The method according to claim 15, wherein the cutting unit further comprises a pressure-reducing mechanism arranged downstream from another switchable valve arranged in the second flow-through area and in the flow direction in the second flow-through area.

19. The method according to claim 15, wherein the cutting unit further comprises a pressure-reducing mechanism arranged upstream from another switchable valve arranged in the second flow-through area and in the flow direction in the second flow-through area.

20. The method according to claim 15, wherein at least the switchable valve in the first flow-through area is controlled by the at least one hole breakthrough sensor.

21. A method of controlling the impingement of water on a workpiece by a water jet or an abrasive water jet in a cutting unit, comprising:

supplying high-pressure water to a control device having a first flow-through area and a second flow-through area;

controlling flow of a portion of the high-pressure water through the first flow-through area using a first switchable valve;

controlling flow of a portion of the high-pressure water through the second flow-through area using a second switchable valve;

piercing a portion of a workpiece with the portion of the water through the second flow-through area; and switching to the portion of water through the first flow-through area to cut the workpiece, wherein the first switchable valve is controlled by the second switchable valve and by at least one hole breakthrough sensor.

* * * * *